US008190075B2

(12) United States Patent
Baba

(10) Patent No.: US 8,190,075 B2
(45) Date of Patent: May 29, 2012

(54) ENDLESS METALLIC BELT, ELECTROPHOTOGRAPHIC ENDLESS BELT, FIXING ASSEMBLY, AND ELECTROPHOTOGRAPHIC IMAGE FORMING APPARATUS

(75) Inventor: Yusuke Baba, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/958,683

(22) Filed: Dec. 2, 2010

(65) Prior Publication Data

US 2011/0081174 A1 Apr. 7, 2011

Related U.S. Application Data

(63) Continuation of application No. PCT/JP2010/005734, filed on Sep. 22, 2010.

(30) Foreign Application Priority Data

Sep. 30, 2009 (JP) ..... 2009-227333

(51) Int. Cl.
*G03G 15/20* (2006.01)

(52) U.S. Cl. ..... 399/329

(58) Field of Classification Search ..... 399/329
See application file for complete search history.

(56) References Cited

U.S. PATENT DOCUMENTS

| | | | | |
|---|---|---|---|---|
| 4,043,658 | A * | 8/1977 | Inoue et al. | 399/249 |
| 4,952,293 | A * | 8/1990 | Sypula et al. | 204/479 |
| 6,961,532 | B2 | 11/2005 | Uekawa et al. | |
| 7,670,241 | B2 | 3/2010 | Aoyama et al. | |
| 2001/0016974 | A1 * | 8/2001 | Someno et al. | 29/557 |
| 2004/0120740 | A1 | 6/2004 | Uekawa et al. | |
| 2005/0170926 | A1 | 8/2005 | Aoyama et al. | |
| 2006/0211343 | A1 * | 9/2006 | Yoshimura et al. | 451/51 |
| 2006/0251451 | A1 | 11/2006 | Ishigami et al. | |
| 2009/0245842 | A1 | 10/2009 | Segawa | |
| 2009/0257794 | A1 * | 10/2009 | Kaino et al. | 399/329 |

FOREIGN PATENT DOCUMENTS

| | | | |
|---|---|---|---|
| CN | 1497394 | | 5/2004 |
| CN | 1306184 | C | 3/2007 |
| EP | 1 548 325 | | 6/2005 |
| JP | 04093957 | A * | 3/1992 |
| JP | 2004-144833 | | 5/2004 |
| JP | 2005-188712 | A | 7/2005 |
| JP | 2009-237185 | | 10/2009 |

* cited by examiner

*Primary Examiner* — David Gray
*Assistant Examiner* — David Bolduc
(74) *Attorney, Agent, or Firm* — Fitzpatrick, Cella, Harper & Scinto

(57) ABSTRACT

An electrophotographic endless metallic belt is provided with improved crack resistance to repeated bending and rubbing against a control member coming into contact therewith, thereby improving its durability. Each edge face of the metallic belt is so shaped as to have a ridge between an outer-surface edge and an inner-surface edge of the metallic belt. As a result, internal stress in the part of the belt that contacts the control member, as a result of contact therewith, is reduced.

3 Claims, 7 Drawing Sheets

ENDLESS METALLIC BELT, ELECTROPHOTOGRAPHIC ENDLESS BELT, FIXING ASSEMBLY, AND ELECTROPHOTOGRAPHIC IMAGE FORMING APPARATUS

CROSS-REFERENCE TO RELATED APPLICATIONS

This application is a continuation of International Application No. PCT/JP2010/005734, filed Sep. 22, 2010, which claims the benefit of Japanese Patent Application No. 2009-227333, filed Sep. 30, 2009.

BACKGROUND OF THE INVENTION

1. Field of the Invention

This invention relates to an endless metallic belt, an electrophotographic endless belt, a fixing assembly, and an electrophotographic image forming apparatus.

2. Description of the Related Art

In an electrophotographic image forming apparatus, an endless belt is used in a fixing assembly by means of which unfixed toner images having been transferred to the surface of a recording medium, such as a paper sheet, is fixed by heat and pressure. As such an endless belt, an electrophotographic endless belt is known which makes use of, as a base layer, an endless metallic belt made of a metal having excellent thermal conductivity and strength as exemplified by stainless steel, nickel, aluminum or copper. In the electrophotographic image forming apparatus, the electrophotographic endless belt used in such a fixing assembly (which belt is hereinafter termed a "fixing belt") is rotatingly driven by using a plurality of rollers. In that case, a force that makes the fixing belt move in its thrust direction (which force is hereinafter also termed "run-aside moving force") may be produced in the fixing belt being rotated. In order to control such a fixing belt movement due to such a force, it is proposed to provide a member which controls the movement in the width direction of the fixing belt or provides a mechanism which detects this movement by using a fixing belt movement detecting member, to correct such movement. In this case, it follows that the fixing belt comes into contact with the above end region controlling member or detecting member at the former's edge face(s). In this case, the fixing belt may crack at its end face(s). Accordingly, in Japanese Patent Application Laid-Open No. 2004-144833, it is proposed to provide a lubricating grease material or a solid lubricating layer in order to improve slidability between a metallic belt edge face(s) and an end region controlling member.

SUMMARY OF THE INVENTION

The present inventor has studied the invention disclosed in Japanese Patent Application Laid-Open No. 2004-144833. As the result, it has been found that, while the lubricity of the end region controlling member is improved and the slidability is improved, the fixing belt may crack as a result of its repeated bending and rubbing with the end region controlling member. Accordingly, the present inventor has recognized that, in order to improve the durability of the image forming apparatus and to increase its speed, it is important to prevent the edges of the fixing belt from cracking.

The present invention is directed to provide an electrophotographic endless belt that can prevent the belt from cracking at its edge(s) even when it is repeatedly bent or rubbed with the end region controlling member. In addition, the present invention is directed to provide an electrophotographic endless belt that can improve the durability of fixing assemblies and image forming apparatus. Further, the present invention is directed to provide a fixing assembly and an electrophotographic image forming apparatus with improved durability.

According to one aspect of the present invention, there is provided an endless metallic belt having an end region surrounded by an outer-surface edge and inner-surface edge thereof, wherein the end region has a ridge which extends along the edges.

According to another aspect of the present invention, there is provided an electrophotographic endless belt comprising the above endless metallic belt and a toner releasing layer.

According to further aspect of the present invention, there is provided a fixing assembly comprising a heating member and a pressure member disposed to oppose the heating member. The heating member or the pressure member or the heating member and the pressure member has the above-noted electrophotographic endless belt. The fixing assembly further comprises an end region controlling member which is so disposed as to be able to come into contact with the ridge of the end region of the endless metallic belt.

According to still another aspect of the present invention, there is provided an electrophotographic image forming apparatus which comprises the above electrophotographic fixing assembly.

According to the present invention, the endless metallic belt comes into contact with the end region controlling member at the former's ridge that may cause a small internal stress by bending. Hence, it can be kept from cracking, thereby improving durability.

Further features of the present invention will become apparent from the following description of exemplary embodiments with reference to the attached drawings.

DESCRIPTION OF THE EMBODIMENTS

The endless metallic belt according to the present invention is described below in detail with reference to the drawings. The endless metallic belt according to the present invention is one having an end region surrounded by an outer-surface edge and an inner-surface edge, and the end region has a ridge which extends along the outer-surface edge and the inner-surface edge of the endless metallic belt.

Figure 2A:
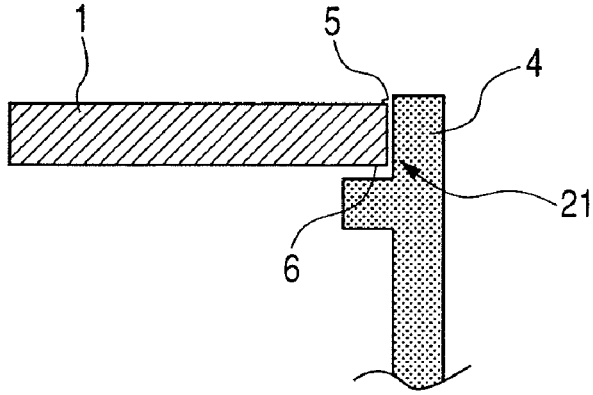
FIG. 2A is a view illustrating how a one-side edge of a conventional metallic belt comes into contact with an end region controlling member.
Figure 2B:
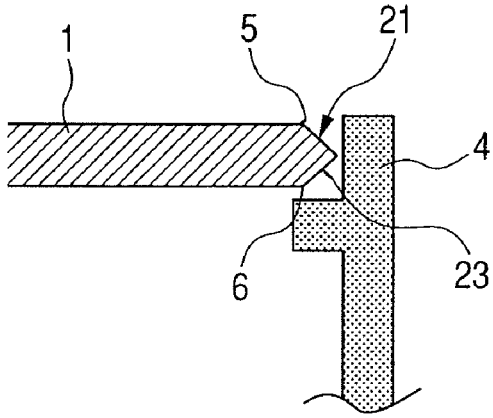
FIG. 2B is a view illustrating how a one-side edge of the metallic belt according to the present invention comes into contact with the end region controlling member.

FIG. 2A is an enlarged sectional view of a part at which a one-side edge of a conventional endless metallic belt 1 comes into contact with an end region controlling member 4. FIG. 2B is an enlarged sectional view of a part at which a one-side edge of an endless metallic belt 1 according to the present invention comes into contact with the end region controlling member 4. The end region controlling member 4 herein termed refers to a member which controls any movement of the endless metallic belt toward its one edge, such as a flange or a roller. The "run-aside moving force" is produced in the endless metallic belt 1 in its thrust direction. Hence, the endless metallic belt is rotated in contact with the end region controlling member while being bent. This makes the endless metallic belt 1 receive sliding resistance from the end region controlling member 4.

Figure 3:
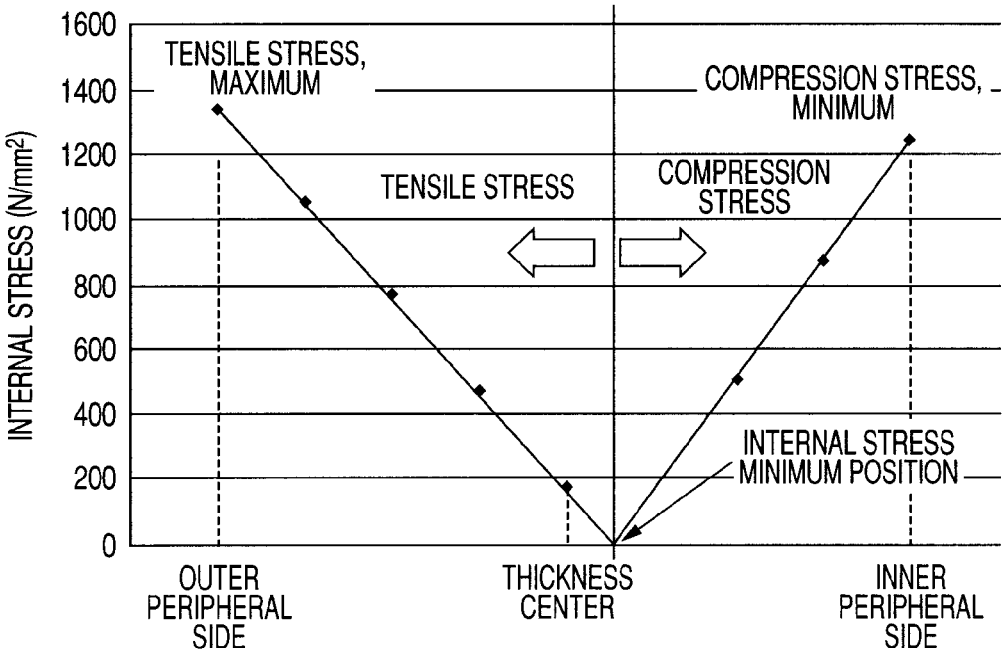
FIG. 3 is a graph showing internal stress acting at a metallic belt edge face.

An internal stress is also produced in the endless metallic belt 1 because of its bending at a fixing nip portion. FIG. 3 is a graph showing how the internal stress acts on the endless metallic belt 1 in its thickness direction when this endless belt is made to bend. As shown in FIG. 3, a tensile stress is produced on the outer peripheral side of the endless metallic belt, and a compression stress on the inner peripheral side of the endless metallic belt. Also, the internal stress becomes minimal at and around the center of the endless metallic belt in its thickness direction. The more the endless metallic belt moves toward its outer periphery from the center and the vicinity thereof in its thickness direction and the more it moves toward its inner periphery therefrom, the larger the internal stress becomes. Hence, the tensile stress becomes a maximum at the outer-surface edge of the endless metallic belt and the compression stress becomes a maximum at the inner-surface edge of the endless metallic belt.

Conventionally, the edge faces of an endless metallic belt have been cut and sanded for the purpose of removing any burrs and cracks. Accordingly, as shown in FIG. 2A, an end region 21 surrounded by an outer-surface edge 5 and inner-surface edge 6 of the endless metallic belt stands flat. In this case, the edge face of the endless metallic belt comes into face-to-face contact with the end region controlling member 4, and hence it receives sliding resistance therefrom at the belt outer-surface edge 5 and the inner-surface edge 6 that may cause a large internal stress by bending. Hence, the endless metallic belt 1 tends to crack at the outer-surface edge 5 of the endless metallic belt 1 and the inner-surface edge 6 of the endless metallic belt 1 that have the largest internal stress as a result of its repeated bending and rubbing with the end region controlling member 4.

On the other hand, as shown in FIG. 2B, in the case when the edge face of the endless metallic belt 1, i.e., an end region 21 surrounded by an outer-surface edge 5 and an inner-surface edge 6 of the endless metallic belt is so shaped as to have a ridge 23, it follows that the endless metallic belt comes into contact with the inner-surface edge at the ridge of the former. Herein, the "ridge" refers to a hill (a raised portion) that continues endlessly between the outer-surface edge and the inner-surface edge of the endless metallic belt and does outward in the width direction of the belt. Then, this ridge has tensile stress and compression stress which cancel each other, to cause a small internal stress. Also, the outer-surface edge 5 and the inner-surface edge 6 of the endless metallic belt that are portions having caused a large internal stress are free from any sliding resistance to be received from the end region controlling member 4. Hence, the endless metallic belt can be well kept from cracking at its edge(s) when the edge face(s) of the endless metallic belt come(s) into contact with the end region controlling member(s). This enables achievement of high speed and high durability in an image forming apparatus making use of, e.g., a fixing belt 7, the endless metallic belt of which has ridges at its edges, each extending between the outer-surface edge and the inner-surface edge of the endless metallic belt.

Figure 4A:
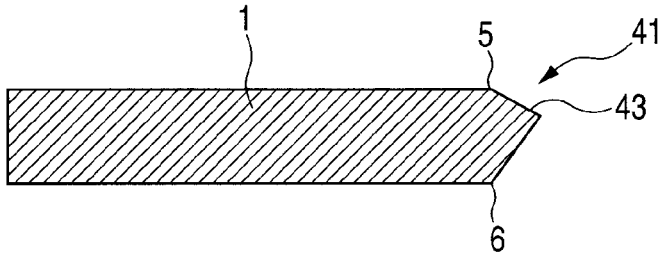
FIG. 4A is a view showing an example of the edge face shape of the metallic belt in the present invention.
Figure 4B:
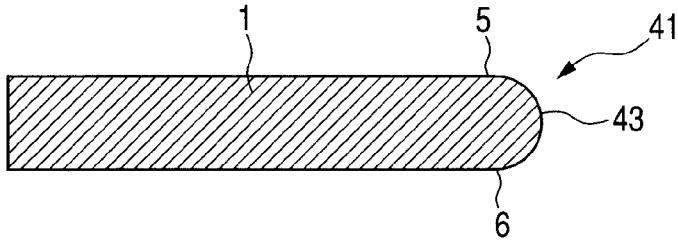
FIG. 4B is a view showing another example of the edge face shape of the metallic belt in the present invention.
Figure 4C:
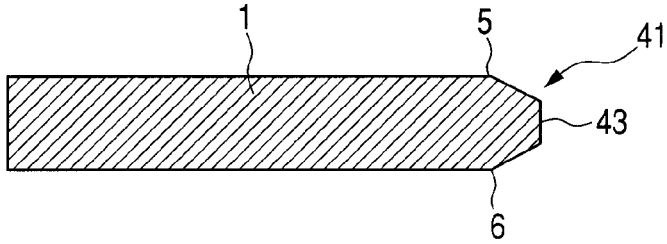
FIG. 4C is a view showing still another example of the edge face shape of the metallic belt in the present invention.

FIGS. 4A to 4C show three embodiments of the endless metallic belt according to the present invention. More specifically, each endless metallic belt 1 has a ridge 43 having a different shape at a region 41 surrounded by an outer-surface edge 5 and inner-surface edge 6 of the belt. For example, FIGS. 4A and 4C show the end region 41 has a ridge 43 having at least two rectilinear portions extending outwardly and extends along the outer-surface edge 5 and the inner-surface edge 6.

Figure 1:
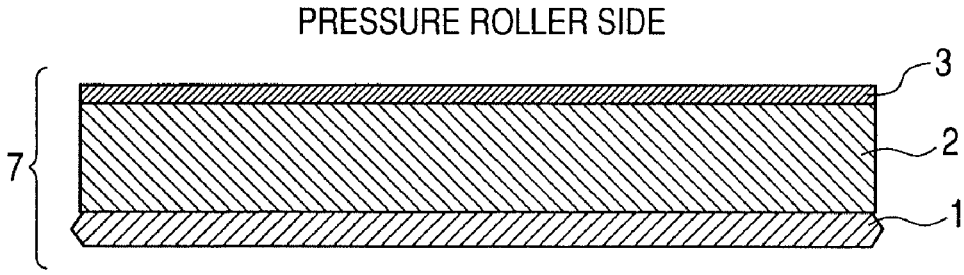
FIG. 1 is a schematic view showing an example of the layer constitution of the fixing belt according to the present invention.

FIG. 1 is a sectional view of a fixing belt (electrophotographic endless belt) 7 making use of the endless metallic belt according to the present invention; this sectional view is taken in the width direction at a part on the side facing a pressure roller. The fixing belt 7 is a layered member consisting essentially of an endless metallic belt 1 according to the present invention, an elastic layer 2 and a toner releasing layer 3.

The endless metallic belt 1 contains stainless steel (SUS), or nickel, aluminum, copper or an alloy of any of these, having superior heat resistance and thermal conductivity. The endless metallic belt 1 may preferably have a total thickness of from 20 μm or more to 200 μm or less.

The elastic layer 2 may be provided or need not be provided. By providing the elastic layer 2, toner images to be heated can be covered at the fixing nip to ensure the conduction of heat thereat, and also the restoring force of the endless metallic belt 1 can be supplemented to relieve any fatigue due to its rotation and bending. Also, by providing the elastic layer 2, the surface of the fixing belt release layer can be improved in its close contact with the surfaces of unfixed toner images to enable conduction of heat with good efficiency. The fixing belt 7 provided with the elastic layer 2 is suitable especially for the heat-fixing of color toner images having a large unfixed-toner-on level.

The elastic layer 2 may be made of any material without any particular limitations. Materials having a good heat resistance and a good thermal conductivity may be selected. The elastic layer 2 may preferably contain at least one material selected from silicone rubber, fluorine rubber and fluorosilicone rubber, and silicone rubber is particularly preferred. Specific examples of the material that forms the elastic layer 2 are shown below. They are polydimethylsiloxane, polymethyltrifluoro-propylsiloxane, polymethylvinylsiloxane, polytrifluoro-propylvinylsiloxane, polymethylphenylsiloxane, polyphenylvinylsiloxane, copolymers of any of these polysilozxanes, and so forth.

The elastic layer may optionally be incorporated with silica, calcium carbonate, quartz powder, zirconium silicate, clay (aluminum silicate), talc (hydrous magnesium silicate), alumina (aluminum oxide), red iron oxide (ferric oxide) or the like.

The elastic layer 2 may preferably have a thickness of from 10 μm or more to 1,000 μm or less, and much preferably from 50 μm or more to 500 μm or less, because a good fixed-image quality can be achieved. Where color images, in particular, photographic images, are printed, solid images are formed over a large area on a recording medium P. In such a case, heating non-uniformity may come about unless the heating surface (release layer 3) can follow the unevenness of the recording medium or the unevenness of toner layers, to cause gloss non-uniformity in images between areas having a high rate of heat transfer and areas having a low rate of heat transfer. That is, glossiness becomes high at the areas having a high rate of heat transfer and glossiness becomes low at the areas having a low rate of heat transfer. If the elastic layer 2 has too small a thickness, the heating surface can not follow any uneven surface profile of the recording medium or toner layers in some cases to cause gloss non-uniformity in images. If, on the other hand, the elastic layer 2 has too large a thickness, the elastic layer 2 may have so high a heat resistance and so large a heat capacity as to make it difficult to achieve a quick start.

The elastic layer 2 may preferably have a hardness (JIS K 6301) of from 3° or more to 60° or less, and much preferably from 5° or more to 45° or less, because the image gloss non-uniformity can sufficiently be kept from occurring and good fixed-image quality can be achieved.

The elastic layer 2 may preferably have a thermal conductivity λ of from $3.3\times10^{-1}$ (W/m·K) or more to $8.4\times10^{-1}$ (W/m·K) or less.

Such an elastic layer 2 may be formed by any of methods as shown in the following paragraphs a) to d).

a) The elastic layer may be formed by a method in which a metallic layer 1 is coated thereon with a material such as liquid silicone rubber by a means such as blade coating, followed by heat curing;

b) the elastic layer may be formed by a method in which the material such as liquid silicone rubber is casted into a mold, followed by vulcanization curing;

c) the elastic layer may be formed by a method in which the material is shaped by extrusion, followed by vulcanization curing; and d) the elastic layer may be formed by a method in which the material is injection-molded, followed by vulcanization curing.

Materials for the toner releasing layer 3 are exemplified below. They are fluorine resins such as PFA (tetrafluoroethylene/perfluoroalkyl ether copolymer), PTFE (polytetrafluoroethylene) and FEP (tetrafluoroethylene/hexafluoropropylene copolymer), silicone resins, fluorosilicone rubbers, fluorine rubbers and silicone rubbers. In particular, PFA is preferred because the toner and so forth can not easily adhere to the toner releasing layer. The toner releasing layer may optionally be incorporated with a conducting agent such as carbon black or tin oxide. The toner releasing layer 3 may have a thickness of from 1 μm or more to 100 μm or less as a standard.

Such a toner releasing layer 3 may be formed by a known method. For example, in the case of a fluorine resin type material, it may be formed by a method in which the endless metallic belt 1 or the elastic layer 2 is coated thereon with a coating material prepared by dispersing a fluorine resin powder, followed by drying or baking, or by a method in which it is covered thereon with a film beforehand made into a tube and the former is bonded to the latter. In the case of a rubber type material, the toner releasing layer may be formed by a method in which a liquid material is casted into a mold, followed by vulcanization curing, a method in which the material is shaped by extrusion, followed by vulcanization curing, or a method in which the material is injection-molded, followed by vulcanization curing.

Figure 5:
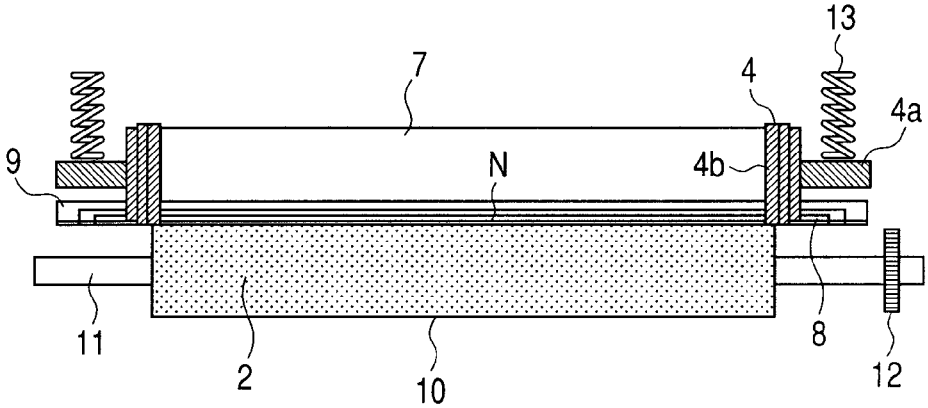
FIG. 5 is a schematic structural view of a fixing assembly making use of a metallic belt 1 according to the present invention.

FIG. 5 is a sectional view in the axial direction of a fixing assembly for the electrophotographic image forming apparatus, making use of the endless metallic belt according to the present invention in the fixing belt.

A heater (heating member) 8 is a ceramic heater or the like making use of alumina or aluminum nitride in its substrate. A heat-insulating stay holder 9 holds the heater 8 on the bottom surface side of the holder, and a fixing belt 7 is fitted to the heat-insulating stay holder 9 at the former's right and left both ends, and is provided with an end region controlling member 4 on each side, which can contact each edge face ridge portion of the fixing belt.

The end region controlling member 4 is a member which controls any movement of the electrophotographic endless belt in its width direction during its travel. The end region controlling member 4 is of an outer receiving die having on each side a spring seat 4*a* provided in an outward integrally projected form and an incomplete annular shaped guard part 4*b* provided in an inward integrally projected form. Reference numeral 10 denotes a heat-resistant elastic pressure roller serving as a pressure member. The pressure roller 10 consists essentially of a mandrel 11 and an elastic layer 2, and is rotatably held by bearings on both end portions of the mandrel 11 and between right and left side plates of a chassis (not shown) of the assembly. Reference numeral 12 denotes a pressure roller rotating drive gear secured to the pressure roller mandrel on its one end side. The fixing belt 7 is disposed on the upper side of the pressure roller 10 and opposite to the pressure roller 10 with the heater 8 side downward.

Then, the fixing belt 7 is kept in uniform pressure contact with the pressure roller 10 by pressing down each spring seat 4*a* of each end region controlling member 4 of the right and left both sides by means of each pressure spring 13 at a stated pressure. Thus, the bottom surface of the heater 8 is brought into pressure contact with the top surface of the pressure roller 10, holding the fixing belt 7 between them, so that a fixing nip zone N is formed in a stated width between the fixing belt 7 and the pressure roller 10.

The fixing belt 7 receives the run-aside moving force in its thrust direction when it is rotatingly driven, because of, e.g., any lack of precision in the component parts of the apparatus and any non-uniform temperature distribution in the lengthwise direction of the ceramic heater 8, and it moves in any of the right and left directions. In order to control such movement in the thrust direction, it is necessary for the assembly to be so set up as to control the thrust-direction movement in such a state that the edge faces of the fixing belt 7 run against end region controlling members such as flanges. The end region controlling member 4 is a controlling member for that purpose. Here, even where the fixing belt 7 is follow-up rotated with the rotation of the pressure roller 10 and has moved in the thrust direction, such movement is so controlled that the ridge of the left side edge face or right side edge face of the fixing belt 7 may come into contact with the inner wall face of the end region controlling member 4. Then, the belt outer-surface edge 5 and the inner-surface edge 6 that have a large internal stress do not come into contact with the end region controlling member 4, and hence do not receive any sliding resistance therefrom. As the result, the fixing belt 7 can be better kept from coming to crack at its edges.

EXAMPLES

Example 1

Figure 8:
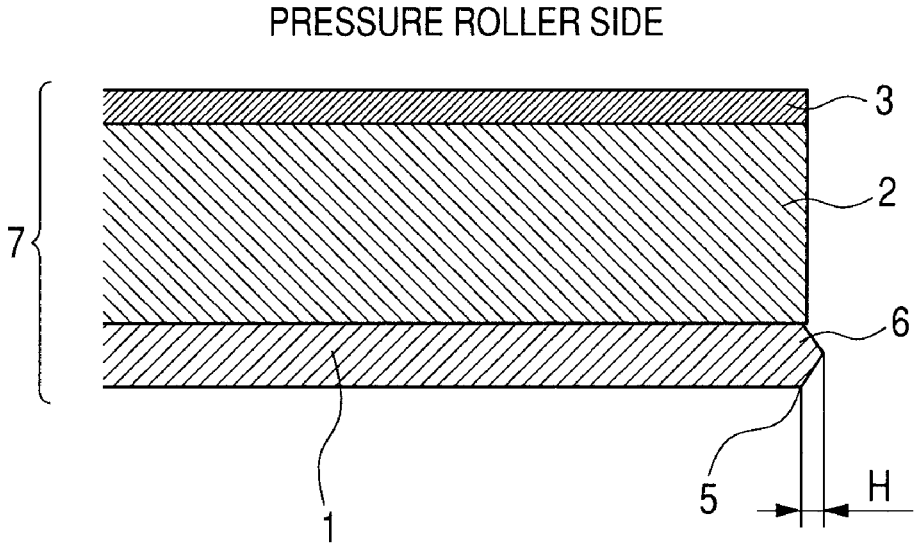
FIG. 8 is a view showing an edge face of a metallic belt in Example 1.

A fixing belt 7 used in Example 1 is shown in FIG. 8. The fixing belt 7 consists essentially of an endless metallic belt 1 and provided thereon in layers are an elastic layer 2 and a toner releasing layer 3. The endless metallic belt 1 was made of stainless steel (SUS), and had an inner diameter of 24 mm, a wall thickness of 30 μm and a length of 240 mm. As shown in FIG. 8, each edge face of the endless metallic belt was worked by a cutting means in such a shape that it had a ridge between a outer-surface edge 5 and a inner-surface edge 6 of the belt, and was made into a raised form of 10 μm in height H in the lengthwise direction at the central position of the wall thickness.

Figure 9:
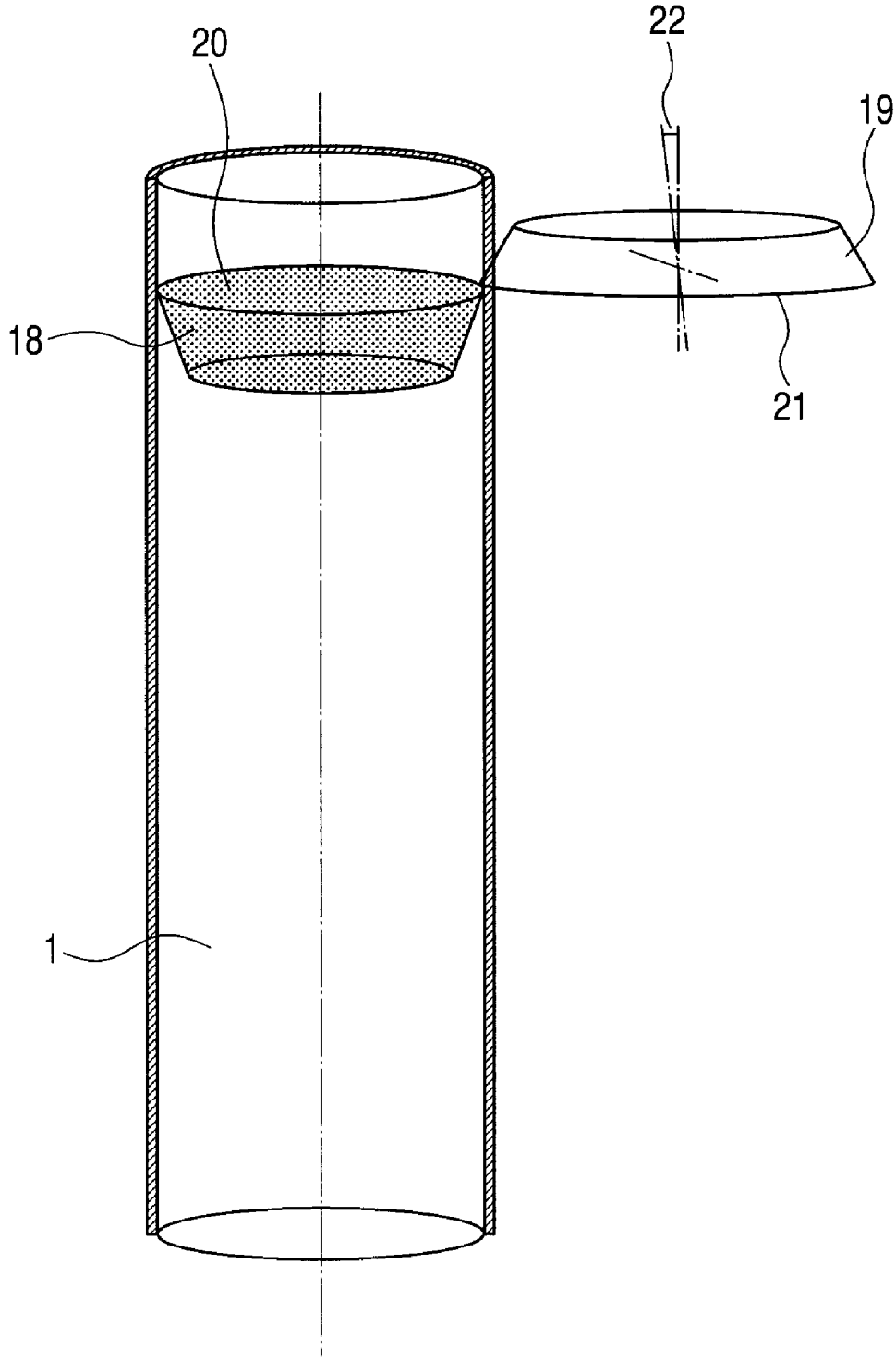
FIG. 9 is a schematic view showing a metallic-belt cutting means.

As the cutting means therefor, it is described with reference to FIG. 9. The endless metallic belt 1 is fixedly held on its inside with a holding mechanism (not shown). The holding mechanism is set to be rotatable, and has a circular knife, inner cutting blade 18. It also has a rotary circular knife, outer cutting blade 19, on the side of outer peripheral direction of the endless metallic belt 1. This pair of e rotary circular knives, inner cutting blade 18 and outer cutting blade 19, are disposed to leave a very small gap between them in such a way that their blade faces (inner cutting blade face 20 and outer cutting blade face 21) can come into contact with each other on their side faces, and also the outer cutting blade is disposed at an angle of inclination 22 with respect to the inner cutting blade. This pair of rotary circular knives were operated to cut the endless metallic belt 1.

A silicone rubber layer (available from GE Toshiba Silicone Co., Ltd.) of 300 μm thickness as the elastic layer 2 and a PFA tube (available from Gunze Sangyo, Inc.) of 20 μm thickness as the toner releasing layer 3, were each layered on the endless metallic belt 1 through a primer to produce a fixing belt having the cross section as shown in FIG. 8. For this fixing belt 7, two belts were readied, and were used in the following running (durability) test.

Figure 6:
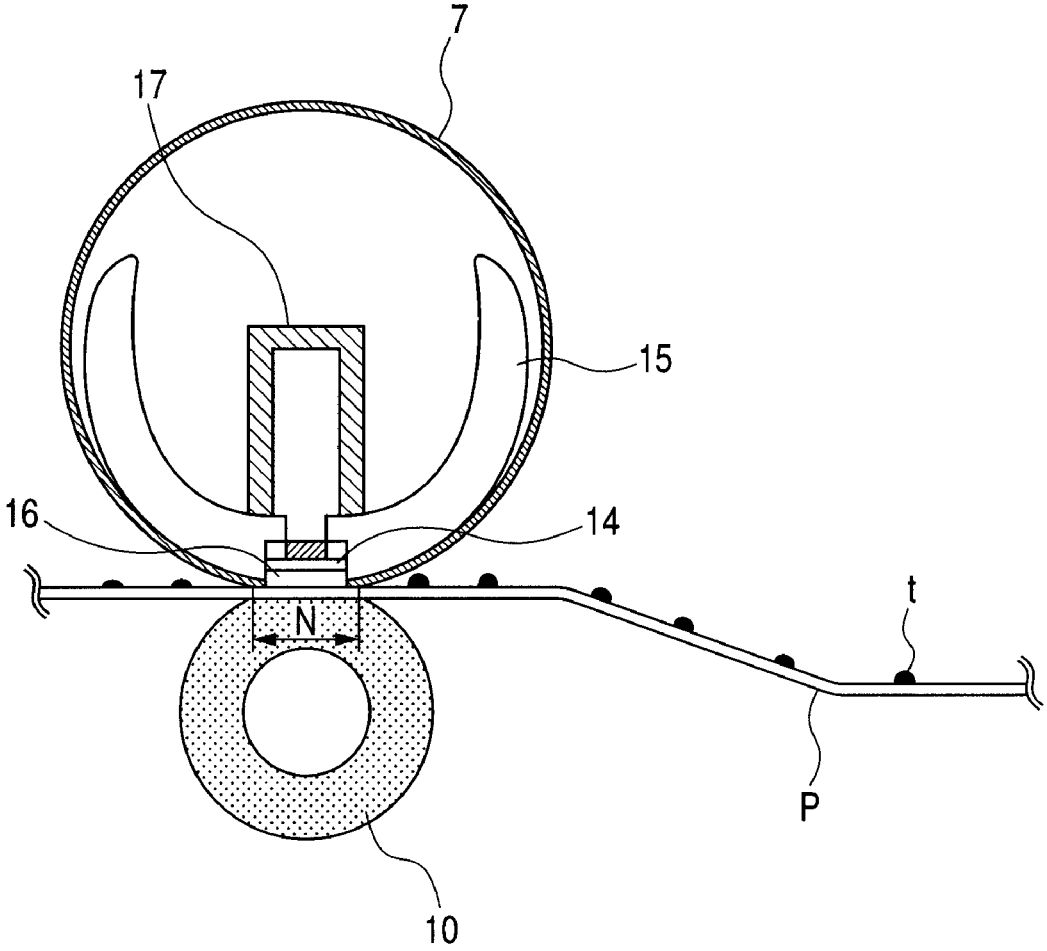
FIG. 6 is a schematic view showing an example of the construction of an image heating unit of a heat fixing system.
Figure 7:
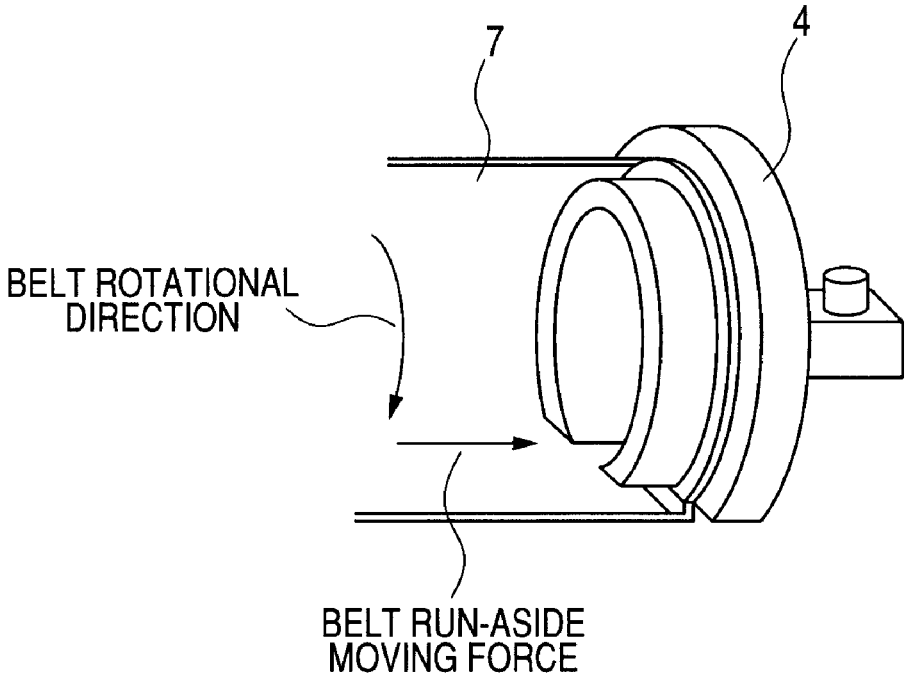
FIG. 7 is a detailed perspective view of a fixing belt edge control part.

Stated specifically, the fixing belt 7 was set in an image heating fixing assembly as shown in FIG. 6, to conduct the running test. In FIG. 6, reference numerals 15, 16 and 17 denote a belt guide member, a sliding plate and a pressuring rigid stay, respectively, and letter symbol t denotes a toner. In the running test, a ceramic heater 14 at the time of fixing was set to 180° C. Unfixed toner images were fixed to a recording medium P by the aid of the heat coming from the ceramic heater and the pressure applied to a nip N. The fixing was performed in an intermittent mode in which it was performed for 1 second for each two-sheet continuous fixing, and the number of sheets at which each fixing belt cracked or broke was counted. The results of the running test for each fixing belt are shown in Table 1.

Comparative Example 1

Figure 10:
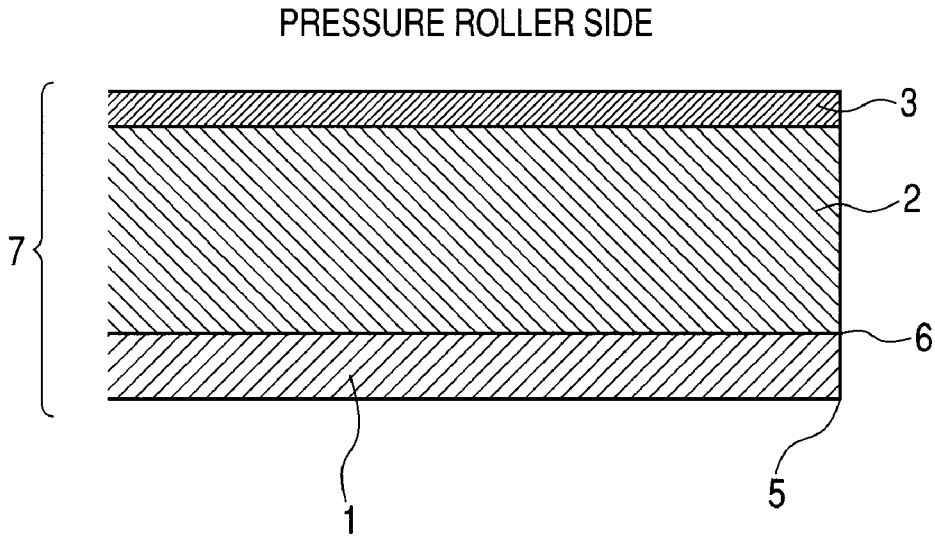
FIG. 10 is a view showing an edge face of a metallic belt in Comparative Example 1.

A fixing belt 7 used in Comparative Example 1 is shown in FIG. 10. Each edge face of an endless metallic belt was worked in the same way as in Example 1 by the cutting means shown in FIG. 9, and thereafter sanded with sand paper (#600) so as to have a plane shape. In this Comparative Example, two fixing belts were produced in the same way as in Example 1 except that the shape of each edge face of the endless metallic belt was made flat, and the same running test as that in Example 1 was conducted. The results of the running test for each fixing belt are shown in Table 1.

TABLE 1

| | Number of sheets for running (sheets) |
|---|---|
| Example 1 | $408 \times 10^3$ |
| | $415 \times 10^3$ |
| Comparative | $270 \times 10^3$ |
| Example 1 | $294 \times 10^3$ |

From the results shown above, it is seen that the fixing belt, the endless metallic belt of which has ridges at its edge faces between the outer-surface edges and the inner-surface edges has a higher durability. This is because the feature that the belt has the ridges at its edge faces makes the belt edge faces come into contact with the part that may cause a small internal stress by bending, in the portions rubbing against the end region controlling member. Hence, the fixing belt can be kept from cracking and from further cracking as a result of its repeated bending and rubbing with the end region controlling member, thereby improving its durability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2009-227333, filed on Sep. 30, 2009, which is herein incorporated by reference as part of this application.

What is claimed is:

1. An electrophotographic endless belt comprising an endless metallic belt and a toner releasing layer, wherein said endless metallic belt has an end region surrounded by an outer-surface edge and inner-surface edge thereof, and said end region has a ridge having at least two rectilinear portions extending outwardly and extends along said outer-surface edge and said inner-surface edge.

2. An electrophotographic fixing assembly comprising a heating member and a pressure member disposed to oppose said heating member, wherein at least one member selected from the group consisting of said heating member and said pressure member comprises said electrophotographic endless belt according to claim 1, and wherein said fixing assembly further comprises an end region controlling member which is so disposed as to be able to come into contact with said ridge of the end region of said endless metallic belt.

3. An electrophotographic image forming apparatus which comprises said electrophotographic fixing assembly according to claim 2.

* * * * *